US006710699B2

(12) United States Patent
Kaltenborn et al.

(10) Patent No.: US 6,710,699 B2
(45) Date of Patent: Mar. 23, 2004

(54) FUSIBLE LINK

(75) Inventors: Uwe Kaltenborn, Baden-Dättwil (CH); Guido Hoffmann, Baden (CH); Mariusz Wilniewczyc, Koszalin (PL); Patrik Huser, Freienwil (CH)

(73) Assignee: ABB Research Ltd, Zurich (CH)

( * ) Notice: Subject to any disclaimer, the term of this patent is extended or adjusted under 35 U.S.C. 154(b) by 0 days.

(21) Appl. No.: 10/173,328

(22) Filed: Jun. 18, 2002

(65) Prior Publication Data

US 2003/0001716 A1 Jan. 2, 2003

(30) Foreign Application Priority Data

Jul. 2, 2001 (EP) ..... 01810642

(51) Int. Cl.[7] ..... H01H 85/046; H01H 85/38

(52) U.S. Cl. ..... 337/297; 337/292; 337/293; 337/273

(58) Field of Search ..... 337/273, 161, 337/164, 256, 292, 293, 297; 29/623

(56) References Cited

U.S. PATENT DOCUMENTS

| | | | | | |
|---|---|---|---|---|---|
| 3,929,660 | A | | 12/1975 | Khalid | |
| 4,494,104 | A | * | 1/1985 | Holmes | 337/403 |
| 4,638,283 | A | | 1/1987 | Frind et al. | |
| 5,097,246 | A | * | 3/1992 | Cook et al. | 337/297 |
| 5,254,969 | A | * | 10/1993 | Caddock, Jr. | 338/308 |
| 5,453,726 | A | | 9/1995 | Montgomery | |
| 5,479,147 | A | | 12/1995 | Montgomery | |
| 5,560,851 | A | * | 10/1996 | Thimm et al. | 219/543 |
| 5,699,032 | A | * | 12/1997 | Ulm et al. | 337/297 |
| 5,726,621 | A | * | 3/1998 | Whitney et al. | 337/297 |
| 5,914,648 | A | * | 6/1999 | Caddock, Jr. | 337/252 |
| 5,914,649 | A | * | 6/1999 | Isono et al. | 337/290 |
| 5,929,741 | A | * | 7/1999 | Nishimura et al. | 337/290 |
| 6,034,589 | A | | 3/2000 | Montgomery et al. | |
| 2002/0004547 | A1 | | 1/2002 | Kaltenborn et al. | |

FOREIGN PATENT DOCUMENTS

| | | | | | |
|---|---|---|---|---|---|
| DE | 4416093 | A1 | | 11/1994 | |
| DE | 19824851 | A1 | | 12/1999 | |
| EP | 270954 | A1 | * | 6/1988 | H01H/85/04 |
| GB | 2110485 | A | | 6/1983 | |
| GB | 2297003 | A | | 7/1996 | |
| JP | 05166454 | A | * | 7/1993 | H01H/85/17 |
| JP | 06036675 | A | * | 2/1994 | H01H/85/048 |
| JP | 06150802 | A | * | 5/1994 | H01H/85/048 |
| WO | 89/08925 | | | 9/1989 | |

* cited by examiner

*Primary Examiner*—Anatoly Vortman
(74) *Attorney, Agent, or Firm*—Burns, Doane, Swecker & Mathis, L.L.P.

(57) ABSTRACT

The fuse is used in the medium- and high-voltage sector and has two spaced-apart power supply connections (2, 3) and an active part (1). The active part comprises a fusible, current-carrying fuse element and an arc-extinguishing medium. The fuse element is connected in an electrically conducting manner to the two power supply connections and is arranged on an electrically insulating substrate. It is of a modular construction and has at least two modules (9) connected in series. The arc-extinguishing medium covers the exposed surfaces of the fuse element. The active part is formed in the manner of a sandwich and has two stable moldings (4, 5) and a predominantly planar intermediate layer (6) arranged between the moldings (4, 5). The intermediate layer (6) contains at least the two series-connected modules, whereas a first molding (4) of the two moldings is formed at least by part of the electrically insulating substrate and the second molding (5) is formed at least by part of the arc-extinguishing medium.

The fuse is distinguished by a simple construction and by favorable triggering characteristics.

17 Claims, 4 Drawing Sheets

FUSIBLE LINK

This application claims priority under 35 U.S.C. §§119 and/or 365 to Appln. No. 01810642.7 filed in Europe on Jul. 2, 2000; the entire content of which is hereby incorporated by reference.

1. Technical Field

The invention is directed to a fuse having two spaced-apart power supply connections and an active part with a fusible, current-carrying fuse element and with an arc-extinguishing medium. The fuse element is connected in an electrically conducting manner to the two power supply connections and is arranged on an electrically insulating substrate. It is of a modular construction and has modules connected in series. The exposed surfaces of the fuse element are covered by arc-extinguishing medium. A fuse of this type is preferably used in medium- and high-voltage systems and in these systems, but also in low-voltage systems, can interrupt strong short-circuit currents and sustained weak overload currents.

2. Prior Art

A fuse of the type stated at the beginning is described, for example, in DE 198 24 851 A1 and U.S. Pat. No. 4,638,283, A. This fuse serves in particular for protecting circuits with high currents and voltages. In the case of this fuse,-a fuse element takes the form of a wire strip. The wire strip is wound onto an asymmetrically configured electrically insulating supporting body. Formed into the wire are evenly spaced-apart constrictions. The two ends of the strip are respectively connected to one of two power supply connections of the fuse. The wound supporting body is accommodated in a housing filled with arc-extinguishing medium, such as quartz sand in particular. When an inadmissible current occurs, the wire is interrupted at the constrictions by melting or by firing of explosive charges. Arcs caused as a result are suppressed by the extinguishing medium.

This fuse is of a relatively complex construction and can only be produced by a large number of working steps. The fuse is therefore relatively expensive. During operation of the fuse, the complex construction of the fuse reduces quite significantly the outward flow of the heat generated by the operating current in the fuse wire. The operating temperature of the fuse is considerably increased in this way. Therefore, the melting temperature of the fuse wire is often already reached when the operating current is still below the permissible current. The arcs occurring when there is this small current contain only a relatively small amount of energy, which may not be sufficient to melt the surrounding sand and interrupt the current by extinguishing the arcs.

Fuses for low voltages, generally of less than 110 V, and for small currents, generally of less than 5 A, are described in U.S. Pat. No. 5,479,147 A, GB 2,110,485 A, WO 89,08925 A, U.S. Pat. Nos. 6,034,589, 5,453,726 and DE 44,16,093 A. These fuses are constructed in the manner of a sandwich and comprise an insulating supporting body, applied to which is an intermediate layer which has a module or a plurality of parallel-connected modules of a fuse element. The sandwich is closed off by a layer which consists of arc-extinguishing material and is arranged on the intermediate layer. These fuses are intended in particular for use in electronic circuits and, without measures to eliminate the risk of an explosion, can only be used in the range of low power outputs.

SUMMARY OF THE INVENTION

The invention, as it is specified in the patent claims, is based on the object of providing a fuse of the type stated at the beginning which is distinguished in the high power-output range by simple construction and favorable triggering characteristics.

In the case of the fuse according to the invention, the active part is formed in the manner of a sandwich and has two stable moldings and a predominantly planar intermediate layer arranged between the moldings. The intermediate layer contains at least two series-connected first modules, increasing the holding voltage, whereas a first molding of the two moldings is formed at least by part of the electrically insulating substrate and the second molding is formed at least by part of the arc-extinguishing medium. On the basis of this design, the active part can now be provided directly with the power supply connections. It is therefore possible to dispense with an otherwise customary fuse housing, since compressed gas produced during triggering of the fuse according to the invention under the effect of the arc is taken up by the surrounding stable moldings.

The planar intermediate layer acting as the fuse element is arranged between stable moldings. Therefore, the fuse element, relieved of mechanical supporting functions, can be designed in virtually any desired way without having to take mechanical requirements into account. Consequently, current path structures made up in any desired way, giving the fuse particularly good triggering properties, can be provided in the fuse element. Since the fuse element is merely surrounded by stable moldings, the heat occurring in the fuse element during the operation of the fuse can be dissipated outward directly by the active part. Moderately heat-conducting quartz sand, otherwise customarily provided as the arc-extinguishing medium, and a housing that additionally hinders heat dissipation are no longer required in the case of the fuse according to the invention. The good heat dissipation from the active part and the simple and precise way in which the fuse element formed as an intermediate layer can be made up improve quite significantly the triggering characteristics of the fuse according to the invention in comparison with a fuse of a customary type of construction.

To increase the power taken up by the fuse, at least two second modules of the fuse element, which are connected in parallel with the first modules, should be additionally provided in the intermediate layer.

The modules are generally of an identical construction and in each case comprise a fuse wire configured in the form of a strip, with a constriction formed between the two ends of the strip. This ensures particularly simple production and activation of the fuse.

The fuse is distinguished by high mechanical strength if the fuse wire is applied to a planar surface of a first molding made of ceramic or glass. Preferably, the ceramic predominantly comprises aluminum oxide, beryllium oxide or aluminum nitride and the glass predominantly comprises borosilicate glass, since these materials conduct heat relatively well and consequently dissipate outward the heat formed in the fuse wire. At the same time, the fuse wire can be applied to the planar surface in a particularly simple way.

The fuse wire is advantageously formed by printing a curable metal paste onto the planar surface of the first molding and by curing the printed-on metal paste. Such technology is particularly advantageous for mass production and reduces the manufacturing costs of the fuse quite significantly. Moreover, this technology makes it possible for fine wire structures to be manufactured with exactly defined cross-sectional dimensions at the constriction of the fuse wire. Such wire structures are essential for good triggering characteristics of the fuse according to the invention. In addition, the fuse wire formed by printing on and curing the metal paste should be heat-treated at a temperature lying slightly below the melting temperature of the metal, since the fuse wire then has great dimensional stability and very constant electrical conductivity, which properties contribute significantly to favorable triggering characteristics.

A fuse with small dimensions and with an advantageously rapid outward flow of heat from the fuse element is achieved if the first molding is formed as a plate. If the fuse wire is applied to the upper side and underside of the plate, the dimensions of the fuse can be additionally reduced. The plate bearing the fuse wire is then covered on the upper side and on the underside by one of two second moldings.

A particularly compact fuse is distinguished by additionally being provided with at least one further first molding, which bears the fuse wire on a planar surface and is arranged with the planar surface on one of two second moldings.

To be able to disconnect even very high short-circuit currents with great certainty, it is recommendable to form in a surface of the second molding adjacent to the intermediate layer at least one material recess for receiving an arc-extinguishing medium in powder form.

The second molding should comprise a crosslinked silicone polymer or a mixture of crosslinked silicone polymers in which a filler based on a mineral compound or a mixture of a plurality of mineral compounds in powder form is embedded. The fuse according to the invention then has particularly great reliability. This is brought about in particular by the material of the arc-extinguishing medium melting at relatively low temperatures in comparison with the quartz sand otherwise customarily used, and then absorbing energy from the switching arcs formed during triggering of the fuse according to the invention, whereby the arc is rapidly and reliably extinguished.

For the fuse according to the invention to have a sufficiently good effect, the proportion of the filler in the silicone polymer should lie in the range from 5% by weight to 95% by weight, preferably in the range from 40% by weight to 85% by weight, and in particular in the range from 60% by weight to 80% by weight, calculated on the basis of the total weight of filler and polymer, and the filler should have an average particle size in the range from 0.5 to 500 $\mu$m, preferably in the range from 10 to 250 $\mu$m and specifically in the range from 20 to 150 $\mu$m, preferably in the range from 30 to 130 $\mu$m, or in the range from 0.5 to 50 $\mu$m, preferably in the range from 0.5 $\mu$m to 10 $\mu$m.

Particularly suitable fillers are metal oxides, preferably aluminum oxide and/or titanium oxide, glasses, mica, ceramic particles, boric acid, metal hydroxides, preferably aluminum hydroxide and/or magnesium hydroxide, and/or mineral substances containing hydrate water, preferably based on aluminum oxide and/or magnesium oxide and/or magnesium carbonate.

DESCRIPTION OF THE DRAWINGS

An exemplary embodiment of the invention is represented in a simplified form in the drawings, in which.

WAYS OF IMPLEMENTING THE INVENTION

Figure 1:
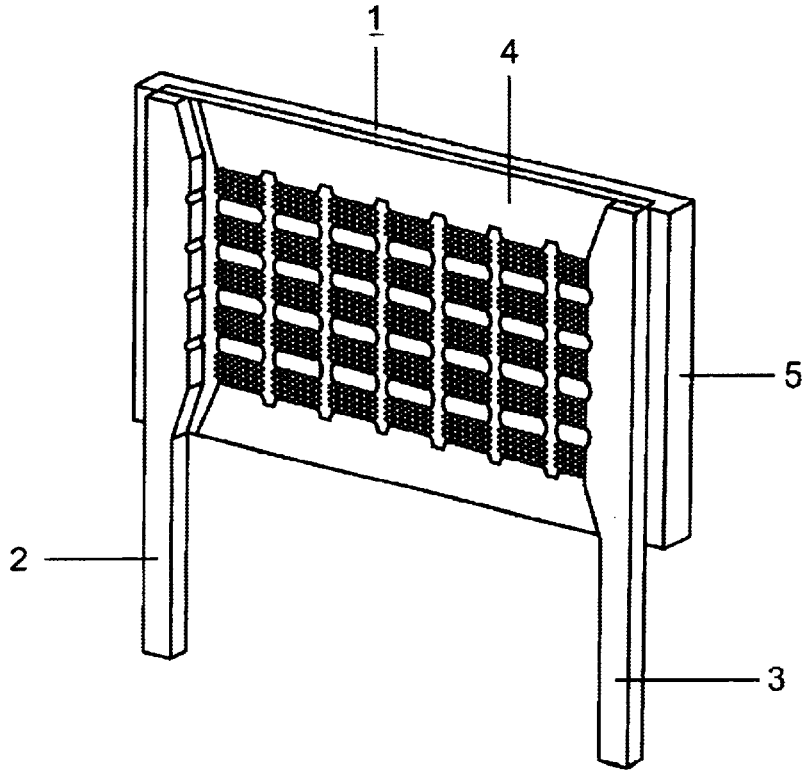
FIG. 1 shows in a -perspective representation an embodiment of the fuse according to the invention in which a part of a molding acting as an arc-extinguishing medium has been removed from the front side.

In all the figures, the same designations relate to parts acting in the same way. The fuse represented in the figures can be loaded with nominal currents of up to 125 A and nominal voltages of up to 8.4 kV. As can be seen from FIGS. 1 and 2, it has an active part 1, and two power supply connections 2, 3 connected to the active part. The active part is formed in the manner of a sandwich and has two stable moldings 4 and 5 and an intermediate layer 6 of material with good electrical conduction, arranged between the two moldings and enclosed by the two moldings. The molding 4 takes the form of a ceramic or glass plate with good thermal conductivity, such as preferably a ceramic plate based on aluminum oxide, beryllium oxide or aluminum nitride or a glass plate based on borosilicate, and bears on the planar side of the plate facing the viewer the intermediate layer 6 serving as the fuse element. The molding 5 encloses the molding 4 with the intermediate layer 6 applied to it and also parts of the power supply connections 2, 3, which are connected in an electrically conducting manner to oppositely arranged ends of the intermediate layer. The molding 5 takes the form of a cast part and can be formed by encapsulating the molding 4 and the power supply connections 2, 3 or by joining together two sub-moldings 5 shown in FIG. 2. In any event, the molding 5 contains arc-extinguishing medium in a portion resting on the intermediate layer 6.

The intermediate layer 6, serving as the fuse element, is formed by applying, preferably printing, a metal paste with good electrical conductivity, for instance based on silver or copper, onto a planar surface of the ceramic or glass plate 4 and subsequent curing of the applied, paste at temperatures between 80 and 180° C. The layer typically has a thickness of several $\mu$m, for example 2 $\mu$m. By heat treatment at a temperature lying slightly below the melting temperature of the metal, for example 90 to almost 100% of said temperature, the intermediate layer 6 is post-cured to improve its homogeneity, mechanical strength and resistance to oxidation and corrosion.

Figure 3:
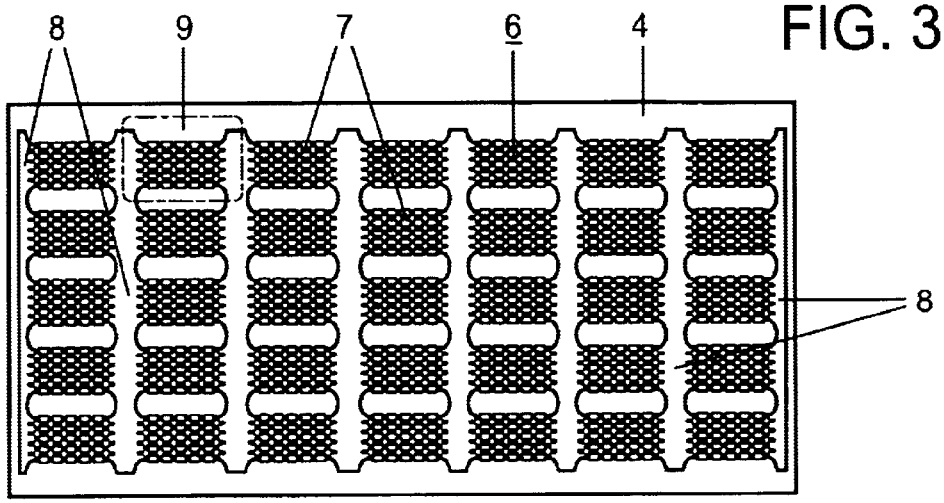
FIG. 3 shows a plan view of a molding of the fuse as shown in FIG. 1, configured as a plate and bearing a fuse element of a modular configuration.
Figure 4:
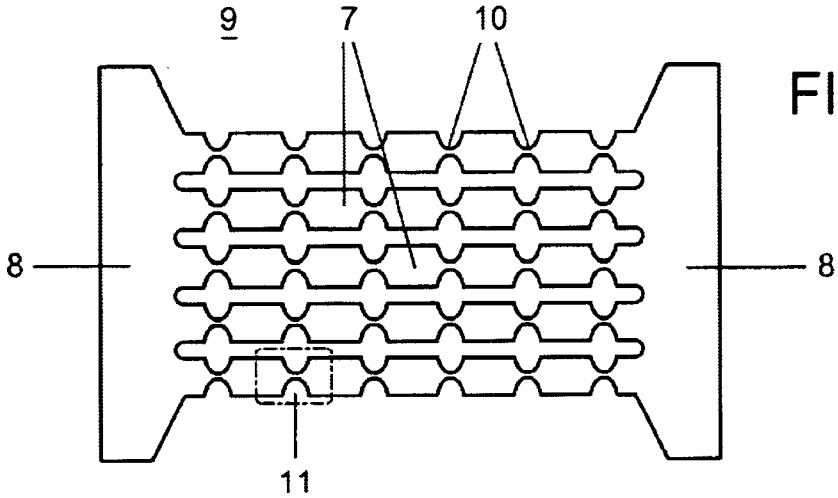
FIG. 4 shows an enlargement of a module, represented in outline, of the fuse element of a modular configuration as shown in FIG. 3.
Figure 5:
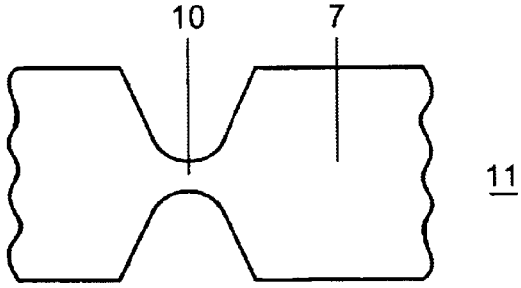
FIG. 5 shows an enlargement of a submodule, represented in outline, of the module as shown in FIG. 4.

The structure of the intermediate layer 6 is then represented in FIGS. 3 to 5. The intermediate layer has a strip structure. The strips identified by the designation 7 represent fuse wires of the fuse element. The strips 7 are arranged in the form of a matrix and are aligned along the rows of the matrix. The ends of the strips 7, extended in the direction of the columns of the matrix, are connected to one another in an electrically conducting manner by cross-strips 8. The strip 8 assigned to the first column and the last column of the matrix is connected in an electrically conducting manner to the power supply connection 2 and 3, respectively.

In this way, a modular construction of the intermediate layer 6 and of the fuse element is achieved. Each matrix element is assigned one of a number of identically formed modules. In FIG. 3, one of the modules is represented in outline and identified by the designation 9.

It can be seen from FIG. 4 that the module has five strips 7 oriented in the direction of the rows of the matrix and lying side-by-side in parallel next to one another. Mutually corresponding ends of the strips 7 are connected to one another by two strips 8 oriented in the direction of the columns of the matrix. Given a thickness of the strips 7 of about 2 to 3 $\mu$m and a width of the strips 7 in the direction of the columns of the matrix of about 1.5 to 2 mm, each of the strips 7 can carry an operating current of about 5 A. The parallel arrangement of the strips 7 allows operating currents of about 25 A to be achieved. By arranging further strips 7 in parallel, the current-carrying capacity can be increased. Each strip 7 consequently again represents a submodule of the module 9. The module 9 is therefore likewise of a modular construction.

At the same time, each strip 7 is also of a modular construction. As can be seen from FIG. 4, it has six constrictions 10, evenly spaced apart from one another in the direction of the strips. Each strip portion comprising such constrictions 10 likewise represents a module. Cone of these modules is represented in outline in FIG. 4 and is identified by the designation 11. A uniform distribution of current at the constriction 10 is achieved if the constriction 10 is arranged at the same distance away from both side edges of the strip 7. The constriction is then bounded by two mirror-symmetrically formed material recesses. Alternatively, however, the constriction may also be arranged on one of the edges of the strip. The constriction is then merely bounded by one material recess, which extends from the other edge up to the constriction. As can be seen from FIG. 5, the profile of the material recess in the region of the constriction is formed in a circularly rounded manner, but may also be configured in a triangular or rectangular manner. Since the fuse wires 7 are in each case produced by printing technology, the cross sections of the strip 7 are set very exactly at the constriction 10 and in the unconstricted region of the strip. This establishes a very narrow temperature range in which the strip 7 melts at the constriction 10. Since all the constrictions melt in this narrow temperature range, particularly good triggering characteristics of the fuse are achieved. This generally makes it possible to dispense with additional means that are customarily used for simultaneously detonating all the constrictions. The series connection of the modules 11 respectively comprising a constriction 10 that is represented in FIG. 4 increases many times over the holding voltage of the fuse after it blows. A voltage of 200 V can typically be held at a melted constriction 10.

The molding 5 comprises a crosslinked silicone polymer or a mixture of crosslinked silicone polymers in which a filler based on a mineral compound or a mixture of a plurality of mineral compounds in powder form is embedded. In comparison with the arc-extinguishing material otherwise customarily used in fuses, sand, this material melts at relatively low temperatures and consequently extracts energy very rapidly from the arcs, whereby reliable triggering is ensured. It is recommendable to fasten the molding 5 with a primer to the molding 4 and to the intermediate layer 6, since oxidation and corrosion influences at the intermediate layer and undesired cracking can largely be avoided in this way.

The modules can be made up and connected together in accordance with operational requirements. The sandwich structure of the active part 1 may also be exhibited not only by the described plate 4 and the fuse element applied as an intermediate layer 6 to one of the two sides of the plate, and by the enveloping pressure-resistant elastomeric molding 5 but also by two intermediate layers arranged on the upper side and underside of the plate that are arranged in parallel or—if there is additional electrical insulation—possibly also arranged in series. There may also be two or more plates stacked one on top of the other, respectively bearing one or two intermediate layers and spaced apart from one another by portions or sub-moldings of the second molding containing arc-extinguishing medium. During the production of the fuse, it must be ensured in particular in this respect that the exposed regions of the intermediate layers are respectively separated from one another by arc-extinguishing medium.

The molding 4 does not necessarily have to be formed as a plate and encapsulated in the molding 5. It is sufficient if merely the planar side of the molding 4 bearing the intermediate layer 6 is covered with material of the molding 5. The remote underside of the molding 4 may be bare and does not necessarily have to be of a planar configuration. It may, for example, have cooling ribs assisting heat dissipation. The same also applies correspondingly to the second molding 5, which likewise does not necessarily have to be of a planar configuration on the side remote from the intermediate layer, but may likewise have cooling ribs or, like the moldings 4, a shielding with the effect of extending the leakage path.

Figure 2:
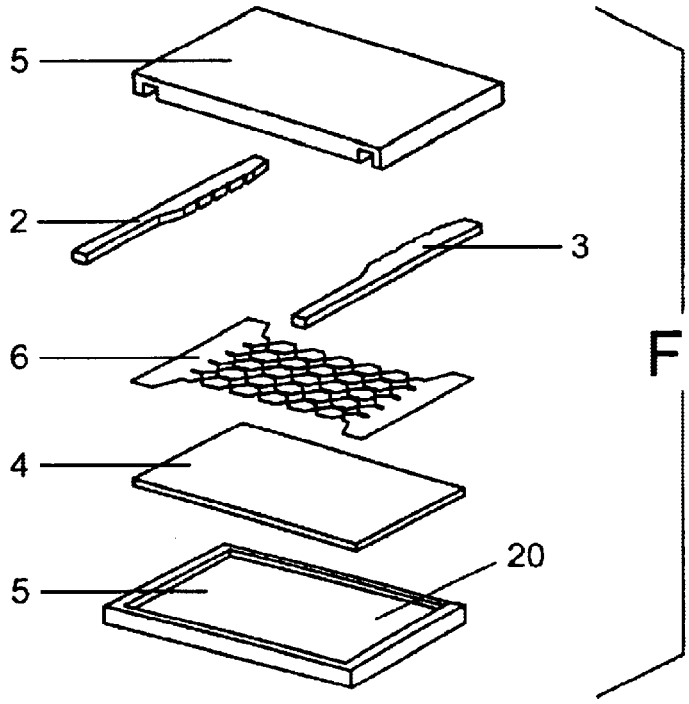
FIG. 2 shows an exploded representation of the fuse as shown in FIG. 1, in which the molding removed from the front side is also represented.
Figure 6:
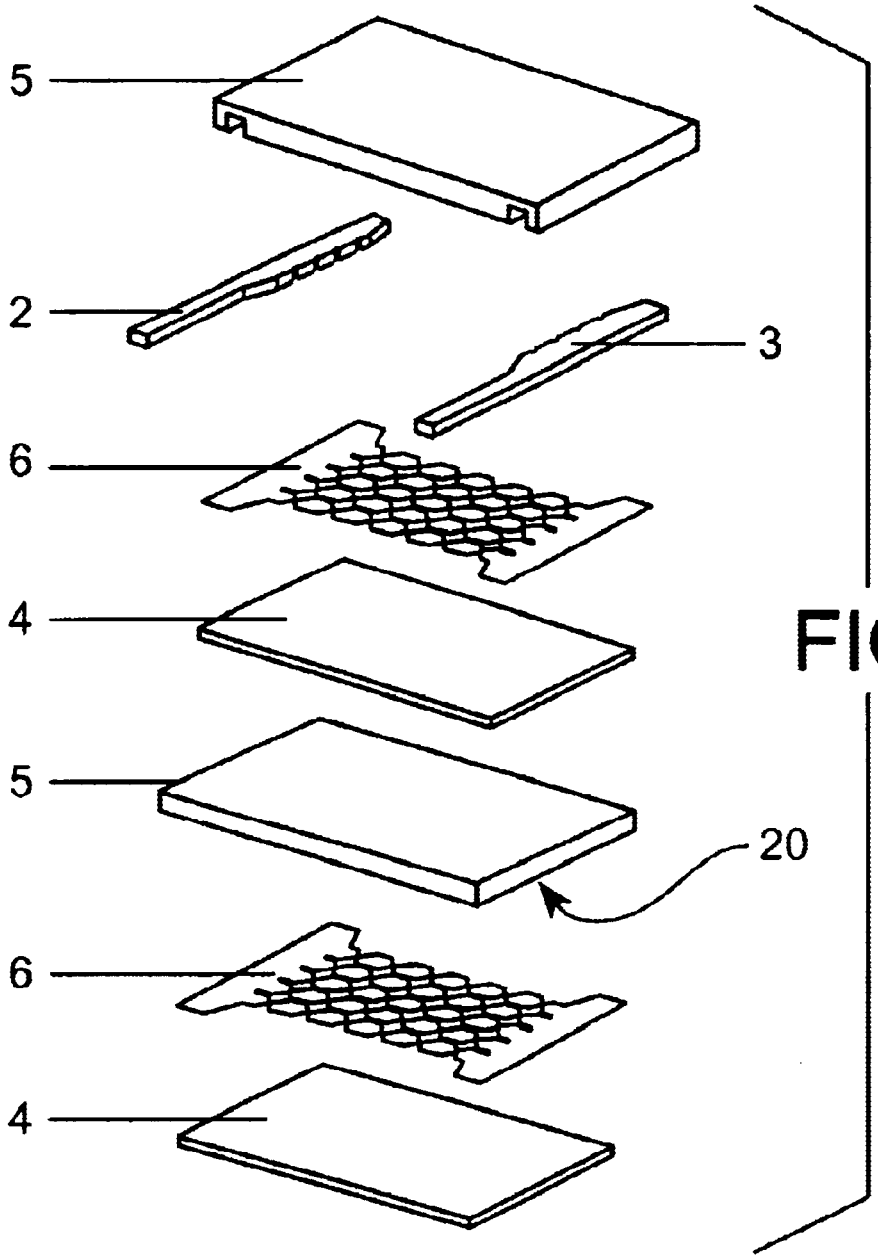
FIG. 6 shows an exploded representation of another embodiment of the fuse.
Figure 7:
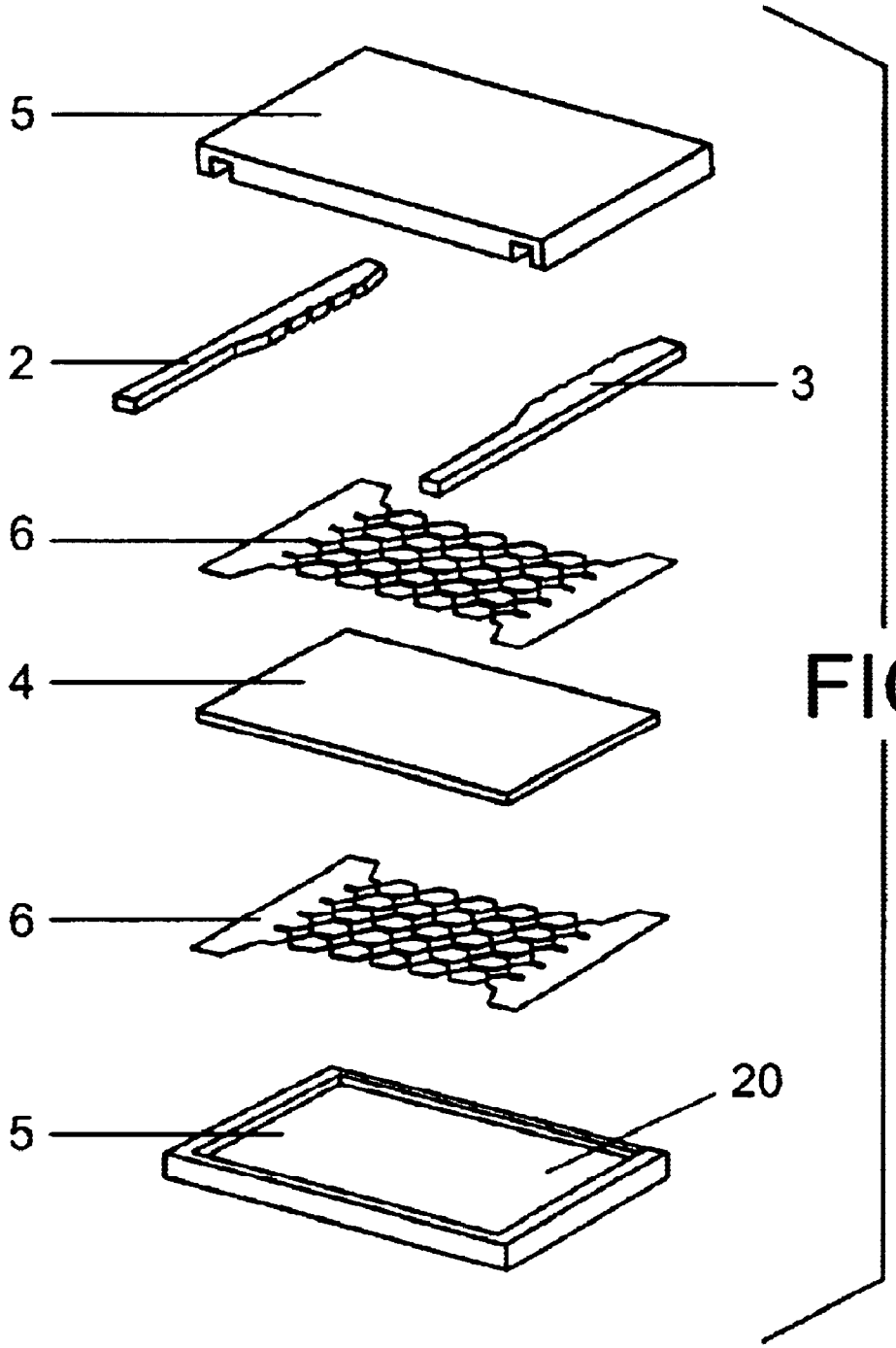
FIG. 7 shows an exploded representation of another embodiment of the fuse.

As can be seen from FIGS. 2, 6 and 7, the molding or sub molding 5 has a material recess 20 receiving the plate 4. A corresponding material recess 20 may also be formed in a surface of the molding or sub-molding 5 adjacent to the intermediate layer 6. The material recess advantageously serves for receiving an arc-exinguishing medium in powder form, such as sand, aluminum oxide, magnesium oxide or quartz powder. Then, very high short-circuit currents can be disconnected with great certainty, since metal vapors thereby produced are adsorbed by the extinguishing medium in powder form.

It is particularly favorable to use a molding 5 of a hydrophobic silicone-containing material which, because of its water-repelling properties, has particularly good open-air characteristics. A material of this type is described in the earlier European patent application 00 810 495.2 of the same applicant, of Jun. 7, 2000.

List of Designations 1 active part
2,3 power supply connections
4 molding or plate or substrate of electrically insulating material
5 molding of arc-extinguishing medium
6 intermediate layer, fuse element
7 fuse wire, strip
8 strip
9 module
10 constriction
11 module

What is claimed is:

1. A fuse with two spaced-apart power supply connections and with an active part comprising a fusible, current-carrying fuse element and an arc-extinguishing medium, in which the fuse element is of a modular construction, has at least two first modules connected in series and is connected in an electrically conducting manner to the two power supply connections and is arranged on an electrically insulating substrate, and in which the arc-extinguishing medium covers the exposed surfaces of the fuse element, wherein the active part is formed in the manner of a sandwich and has two stable moldings and a predominantly planar intermediate layer arranged between the two moldings, the intermediate layer containing at least the two series-connected first modules, whereas a first molding of the two moldings is formed at least by part of the electrically insulating substrate and the second molding is formed at least by part of the arc-extinguishing medium, and wherein at least two second modules of the fuse element, which are connected in parallel with the first modules, are additionally provided in the intermediate layer.

2. The fuse as claimed in claim 1, wherein the first and/or second modules are of an identical construction and in each case comprise a fuse wire configured in the form of a strip, with a constriction formed between the two ends of the strip.

3. The fuse as claimed in claim 2, wherein the fuse wire is applied to a planar surface of a first, molding made of ceramic or glass.

4. The fuse as claimed in claim 3, wherein the ceramic predominantly comprises aluminum oxide, beryllium oxide or aluminum nitride and the glass predominantly comprises borosilicate glass.

5. The fuse as claimed in claim 3, wherein the fuse wire is formed by printing a curable metal paste onto the planar surface of the first molding and by curing the printed-on metal paste.

6. The fuse as claimed in claim 5, wherein the fuse wire formed is additionally heat-treated at a temperature lying slightly below the melting temperature of the metal.

7. The fuse as claimed in claim 3, wherein the first molding is formed as a plate.

8. The fuse as claimed in claim 7, wherein the fuse wire is applied to the upper side and/or underside of the plate.

9. The fuse as claimed in claim 3, wherein at least one further first molding, which bears the fuse wire on a planar surface and is spaced from the other first molding by portions or sub-moldings of the second molding, is additionally provided.

10. The fuse as claimed in claim 1, wherein a material recess for receiving an arc-extinguishing medium in powder form is formed in a surface of the second molding adjacent to the intermediate layer.

11. The fuse as claimed in claim 1, wherein the second molding comprises a crosslinked silicone polymer or a mixture of crosslinked silicone polymers in which a filler based on a mineral compound or a mixture of a plurality of mineral compounds in powder form is embedded.

12. The fuse as claimed in claim 11, wherein the proportion of the filler in the silicone polymer lies in the range from 5% by weight to 95% by weight, preferably in the range from 40% by weight to 85% by weight, and in particular in the range from 60% by weight to 80% by weight, calculated on the basis of the total weight of, filler and polymer, and in that the filler has an average particle size in the range from 0.5 to 500 um, preferably in the range from 10 to 250 um and specifically in the range from 20 to 150 um, preferably in the range from 30 to 130 um, or in the range from 0.5 to 50 um, preferably in the range from 0.5 um to 10 um.

13. The fuse as claimed in claim 12, wherein the filler comprises metal oxide, preferably aluminum oxide and/or titanium oxide, glasses, mica, ceramic particles, boric acid, metal hydroxides, preferably aluminum hydroxide and/or magnesium hydroxide, and/or mineral substances containing hydrate water, preferably based on aluminum oxide and/or magnesium oxide and/or magnesium carbonate.

14. A fuse with two spaced-apart power supply connections and with an active part comprising a fusible, current-carrying fuse element and an arc-extinguishing medium, in which the fuse element is of a modular construction, has at least two first modules connected in series and is connected in an electrically conducting manner to the two power supply connections and is arranged on an electrically insulating substrate, and in which the arc-extinguishing medium covers the exposed surfaces of the fuse element, wherein the active part is formed in the manner of a sandwich and has two stable moldings and a predominantly planar intermediate layer arranged between the two moldings, the intermediate layer containing at least the two series-connected first modules, whereas a first molding of the two moldings is formed at least by part of the electrically insulating substrate and the second molding is formed at least by part of the arc-extinguishing medium, and wherein a material recess for receiving an arc-extinguishing medium in powder form is formed in a surface of the second molding adjacent to the intermediate layer.

15. The fuse as claimed in claim 14, wherein the second molding comprises a crosslinked silicone polymer or a mixture of crosslinked silicone polymers in which a filler based on a mineral compound or a mixture of a plurality of mineral compounds in powder form is embedded.

16. The fuse as claimed in claim 15, wherein the proportion of the filler in the silicone polymer lies in the range from 5% by weight to 95% by weight, preferably in the range from 40% by weight to 85% by weight, and in particular in the range from 60% by weight to 80% by weight, calculated on the basis of the total weight of filler and polymer, and in that the filler has an average particle size in the range from 0.5 to 500 um, preferably in the range from 10 to 250 um and specifically in the range from 20 to 150 um, preferably in the range from 30 to 130 um, or in the range from 0.5 to 50 um;, preferably in the range from 0.5 um to 10 um.

17. The fuse as claimed in claim 16, wherein the filler comprises metal oxide, preferably aluminum oxide and/or titanium oxide, glasses, mica, ceramic particles, boric acid, metal hydroxides, preferably aluminum hydroxide and/or magnesium hydroxide, and/or mineral substances containing hydrate water, preferably based on aluminum oxide and/or magnesium oxide or magnesium carbonate.

* * * * *